US008371557B1

(12) United States Patent
Buck

(10) Patent No.: US 8,371,557 B1
(45) Date of Patent: Feb. 12, 2013

(54) DUMPSTER LID OPENER

(76) Inventor: Frank Buck, Layton, UT (US)

( * ) Notice: Subject to any disclaimer, the term of this patent is extended or adjusted under 35 U.S.C. 154(b) by 773 days.

(21) Appl. No.: 12/462,769

(22) Filed: Aug. 10, 2009

(51) Int. Cl.
*B66D 1/36* (2006.01)

(52) U.S. Cl. ..... 254/325; 220/262; 220/263; 220/908

(58) Field of Classification Search ..... 254/323, 254/324, 325; 220/263, 262, 908, 264, 260
See application file for complete search history.

(56) References Cited

U.S. PATENT DOCUMENTS

| | | | | |
|---|---|---|---|---|
| 3,989,162 | A | 11/1976 | Hodge et al. | |
| 4,186,844 | A | 2/1980 | Swanson | |
| 4,456,141 | A | 6/1984 | Pamment | |
| 4,892,218 | A * | 1/1990 | Reiling | 220/263 |
| 5,011,036 | A * | 4/1991 | Souza et al. | 220/263 |
| 5,105,967 | A | 4/1992 | Horpestad | |
| 5,147,056 | A * | 9/1992 | Ma | 220/263 |
| 5,195,726 | A * | 3/1993 | Kaner | 254/325 |
| 5,348,222 | A * | 9/1994 | Patey | 232/43.2 |
| 5,772,183 | A * | 6/1998 | Sears | 254/324 |
| 5,857,223 | A * | 1/1999 | Ferdinand | 4/246.1 |
| 6,138,855 | A * | 10/2000 | Kopf | 220/263 |
| 6,371,449 | B1 * | 4/2002 | Chamberlain | 254/387 |
| 6,554,254 | B2 * | 4/2003 | Vetesnik | 254/325 |
| 6,685,170 | B1 * | 2/2004 | Gwynn | 254/325 |
| 7,594,641 | B2 * | 9/2009 | Sharp | 254/325 |
| 7,607,552 | B2 * | 10/2009 | Efstathiou | 220/264 |
| 7,874,544 | B2 * | 1/2011 | Monroe | 254/285 |
| 8,038,125 | B2 * | 10/2011 | Troy et al. | 254/338 |
| 8,146,767 | B1 * | 4/2012 | Grant | 220/263 |
| 2006/0076543 | A1 * | 4/2006 | Williamson | 254/325 |
| 2009/0084788 | A1 * | 4/2009 | Yang et al. | 220/263 |
| 2011/0120997 | A1 * | 5/2011 | Most | 220/263 |

* cited by examiner

*Primary Examiner* — Emmanuel M Marcelo
(74) *Attorney, Agent, or Firm* — Richard L. Mikesell

(57) ABSTRACT

A unit opens the lid of a dumpster in response to downward movement of a foot-operated pedal that is translated into upward motion by a lever rotatably mounted on a frame and connected to one end of a tether cord which is attached at the other end thereof to the dumpster lid. The weight of the lid is applied to the tether cord, and via the tether cord to the foot pedal via a cord attached to the lever and will move the foot-operated pedal back into its initial position upon release of the pedal. Another form of the invention can include an electromechanical system which is operated by a push button.

5 Claims, 2 Drawing Sheets

DUMPSTER LID OPENER

TECHNICAL FIELD OF THE INVENTION

The invention relates to waste containers or "dumpsters" designed for emptying into a waste removal truck by mechanical means. More particularly it relates to improvements in the lids for dumpsters.

BACKGROUND OF THE INVENTION

Waste is generally stored in large, wheeled metal bins referred to as "dumpsters" which are designed to be emptied mechanically by specially equipped garbage trucks having hydraulically-operated lifting arms or forks which engage, lift and tip the dumpster.

Trash bins have one or more hinged lids that can be opened to deposit trash into the bin. The bins are designed to be emptied by a trash truck. A hydraulically operated lift on the truck engages the trash bin using two forks, lifts it above the truck, and inverts the bin. The lids swing open, and the contents of the bin fall into the truck.

The lids of conventional trash bins are mounted on hinges at the rear wall of the bin adjacent the rim of the bin. When the lids are closed, they are oriented generally horizontally and perpendicular to the side walls of the trash bin. The lids can be swung open approximately 270 degrees to an orientation in which they are generally parallel to the rear wall of the trash bin. After a user has opened a lid in this manner and deposited the trash, the opened lid is out of the user's reach, and the user therefore must walk to the rear of the trash bin to close the lid. A user can avoid this inconvenience by holding on to the lid with one hand while depositing trash with the other hand, but this procedure is also inconvenient because a user may desire to use both hands to deposit the trash.

It is important that water be kept out of such containers, since users pay for removal by weight. To avoid becoming filled with rainwater, a lid must be provided for the dumpster which is hinged to permit filling and emptying of the dumpster. Such lids are metal and are generally formed in two parts due to the large weight of such lids. Even so, such lids are difficult for a user to lift and also leak some water into the container. The lids also tend to become bent when dumping into a full garbage truck, as the lid presses against the mound of trash. Such bending adds to the leakage problem in the container. Furthermore, food wastes and numerous other waste materials which are placed in waste containers can attract vermin and insects if the waste material is left exposed. Most constructions of waste containers presently used are provided with lids which do not completely seal the container and some lids are formed with openings at the corners thereof which allow access to the waste within the container thereby also allowing vermin and insects into the container. Such containers are therefore a health risk, particularly when used with food wastes and the like. It is desirable to provide a lid which, when closed, seals the container against the ingress of vermin, flies and the like, but which will not constitute a danger to users of the container. However, such a lid may be difficult for a user to open, especially if the user is carrying packages to be deposited in the dumpster.

As such, one of the difficulties in providing a lid for a waste container is to provide a lid construction such that the lid is relatively easy to open for the insertion of waste material into the container and is relatively easy to close but with the lid construction being sufficiently robust that it is not damaged through mis-use and/or incorrect container emptying procedures. Further, the lid should be constructed to facilitate emptying of the contents by mechanical handling equipment.

Therefore, there is a need for a means to easily open a dumpster lid in a hands-free manner.

SUMMARY OF THE INVENTION

These, and other, objects are achieved by a unit which will open the lid of a dumpster in response to downward movement of a foot-operated pedal that is translated into upward motion by a lever rotatably mounted on a frame and connected to one end of a tether cord which is attached at the other end thereof to the dumpster lid. The weight of the lid is applied to the tether cord, and via the tether cord to the foot pedal via a cord attached to the lever and will move the foot-operated pedal back into its initial position upon release of the pedal. Another form of the invention can include an electromechanical system which is operated by a push button.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Other objects, features and advantages of the invention will become apparent from a consideration of the following detailed description and the accompanying drawings.

Figure 1:
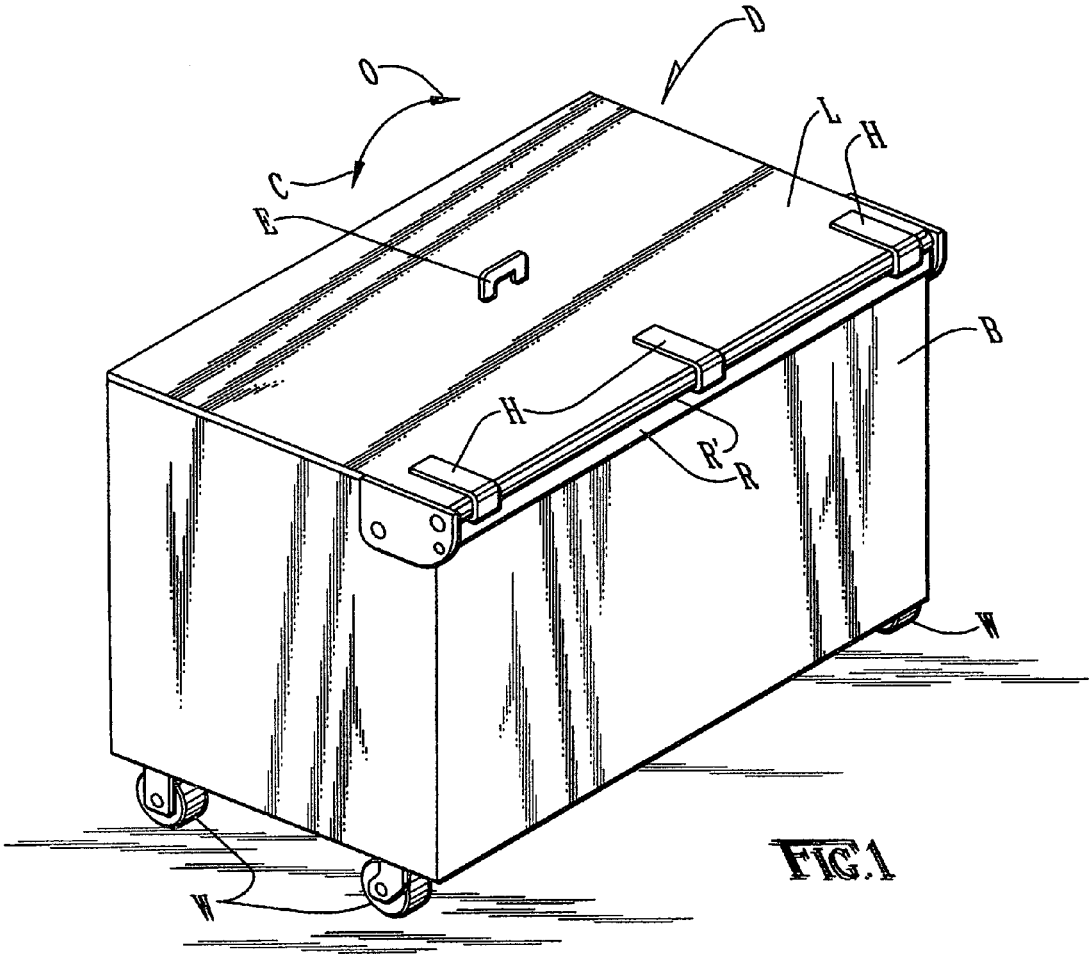
FIG. 1 is a perspective view of a dumpster having a lid which must be lifted in order to deposit trash into the dumpster.

Referring first to FIG. 1, it can be understood that a dumpster D has a base B mounted on wheels W so it can be moved as needed. A lid L is hingeably mounted on base B by hinges, such as hinge H connected to reinforcement elements R and R' to pivotally move in directions O and C shown in FIG. 1 to open and close the dumpster. Lid L also has a lifting element E which is grasped to open or close the lid. As discussed above, lid L may be heavy and may be in a location relative to a user which makes it difficult for the user to operate the lid, especially if the user is handicapped.

Figure 2:
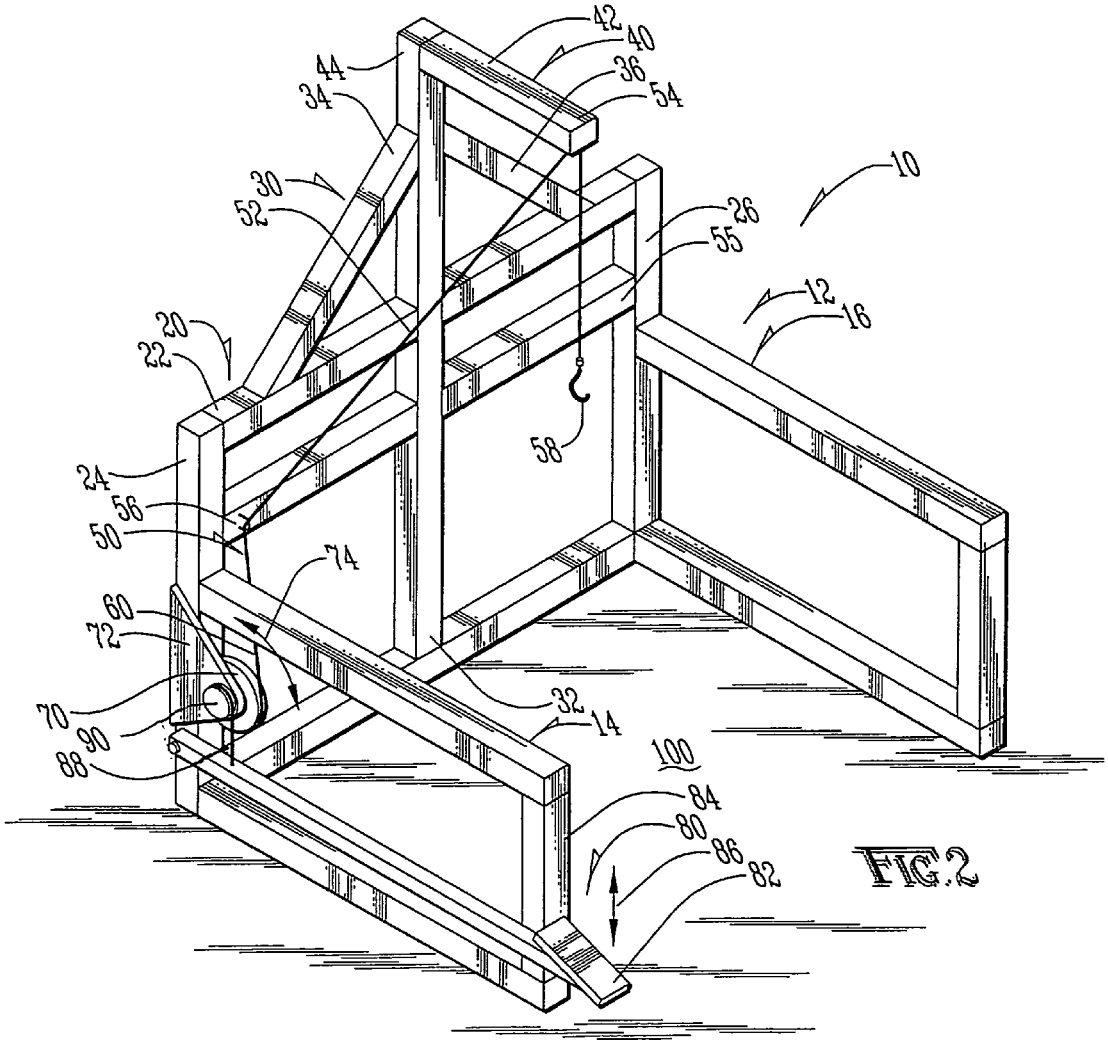
FIG. 2 is a perspective view of a mechanism for lifting a lid of a dumpster and which embodies the principles of the present invention.

Referring next to FIG. 2, it can be understood that the present invention is embodied in a unit 10 which is associated with dumpster D to lift the cover or lid L of that dumpster. Unit 10 includes a U-shaped frame 12 which is located adjacent to the end of the dumpster and which includes two identical side panels 14 and 16 connected by a bight panel 20 having a cross beam 22 connecting two upright support beams 24 and 26 together. A support unit 30 is attached to crossbeam 22 of panel 20 and includes a stanchion 32 which is oriented upright when in use as can be understood from FIG. 1 and is supported by two support elements 34 and 36 attached to crossbeam 22 of the panel 20 and to the stanchion. An overhanging element 40 is attached at one end 42 thereof to a distal end 44 of the stanchion whereby the overhanging element extends over the lid of the dumpster when the dumpster is located adjacent to unit 10.

A lid lifting mechanism 50 is associated with side panel 14 and with support unit 30. Lifting mechanism 50 includes a first tether cord 52 slidably attached to distal end 54 of overhanging element 30. Tether cord 52 is slidably attached to crossbeam 55 of panel 20 by a fastener 56 and has a distal end 58 which is attached to lifting element E on the dumpster lid and a proximal end 60 which is attached to a rotatable lever element 70 so rotational movement of the lever element causes concomitant linear movement of tether cord distal end 58. Lever element 70 is rotatably mounted on upright support beam 24 of side panel 14 by a mounting element 72 to move in the directions indicated by double-headed arrow 74 when activated. Lever element 70 is rotated by a foot pedal unit 80 which includes a foot pedal 82 mounted on upright support beam 84 of side panel 14 to move up and down as indicated by double-headed arrow 86 and a second tether 88 which is wound around pin 90 and which connects the foot pedal to the lever element in a manner such that the lever element rotates in response to upward or downward movement of the foot pedal movement whereby foot pedal linear movement is transmitted to the lever element and translated into rotational movement of the lever element by pin 90.

With dumpster D located in area 100 of unit 10 and distal end 58 of tether cord 52 connected to lifting element E, downward force on the foot pedal causes the lever element to rotate in a manner which moves distal end 58 of the tether cord upwardly, and downward force on the tether cord distal end caused by the weight of the dumpster lid causes upward movement of the foot pedal. The upward movement of the foot pedal returns it to the initial position so it can be operated to lift the lid of the dumpster again.

In this manner, the lid of a dumpster can be opened by simply stepping on a foot pedal. Unit 10 can be separated from the dumpster so it will not interfere with the unloading of the dumpster.

Alternatively, a piston mechanism can be mounted on upright support beam 84 of side panel 14 to be located super-adjacent to foot pedal 82 and to have a piston thereof in contact with the foot pedal. The piston mechanism can be powered either by utility power, battery power or solar power and includes a circuit having an on/off switch and an activating system that causes the piston to extend when the piston mechanism is activated and to retract when the piston mechanism is de-activated by means of the on/off switch. The piston mechanism can be located to force the foot pedal downward when the mechanism is activated thereby lifting the lid of the dumpster and allowing the foot pedal to return to its standby position with the lid of the dumpster lowered under the force of gravity into position to close on the dumpster when the piston mechanism is de-activated allowing the piston to return to a rest position in a cylinder of the mechanism. The piston mechanism can be solenoid controlled or hydraulic.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A unit for opening and closing a lid of a dumpster comprising:

a tether cord mounted on a frame in position to be attached to a lid of a dumpster for use, the tether cord moving between a lid lifting position and a lid closing position to open and close the lid of the dumpster;

a foot pedal mounted on the frame to move between a first position and a second position; and a lever unit lever unit element rotatably mounted on the frame and a first cord attaching the lever element to the foot pedal, the tether cord being attached to the lever element connecting the foot pedal to the tether cord in a manner such that when the foot pedal is in the first position the lid of the dumpster is closed and when the foot pedal is in the second position the lid of the dumpster is open.

2. The unit defined in claim 1 wherein the frame is U-shaped and the dumpster is located therein during use.

3. The unit defined in claim 2 further including a stanchion mounted on the frame and an overhanging element mounted on the stanchion to be located over the lid of the dumpster when the dumpster is located in the frame during use.

4. The unit defined in claim 3 further including support elements connected to the stanchion and to the frame.

5. A unit for opening and closing a dumpster comprising:

a dumpster having a lid which is opened and closed for use and a lid lifting element on the lid which is used to lift and lower the lid for use;

a frame unit located adjacent to the dumpster and including two side panels, a bight section connecting the side panels together to define a U-shape with the dumpster being located between the side panels and adjacent to the bight section, a cross beam on the bight section, and an upright support beam on one of the side panels;

a support unit mounted on the cross beam of the bight section and including a stanchion mounted on the cross beam of the bight section to extend upwardly in use, two support elements each connected at one end thereof to the cross beam of the bight section and at another end thereof to the stanchion, and an overhanging element extending horizontally in use and having one end thereof connected to one end of the stanchion and having a second end thereof located above the lid of the dumpster when the dumpster is located between the side panels and the bight section of the frame unit;

a lid lifting mechanism mounted on the frame unit and including a foot pedal mounted on the upright support beam of the frame unit, a first tether cord slidably mounted on the second end of the overhanging element and having a distal end which is located above the lid lifting element on the dumpster lid for use, the first tether cord having a second end, a rotatable lever element rotatably mounted on the frame unit, the rotatable lever element having a pin thereon, the second end of the first tether cord being wound around the pin to be connected to the rotatable lever element to rotate the lever element in response to movement of the foot pedal, and to move the first tether cord up and down on the overhanging element in response to rotation of the rotatable lever element, a second tether cord having one end thereof wound around the lever element and a second end thereof connected to the foot pedal to translate movement of the foot pedal into rotational movement of the lever element;

whereby movement of the foot pedal is translated into linear movement of the tether cord to lift the lid of the dumpster when the foot pedal is forced downwardly.

* * * * *